United States Patent [19]

Koizumi et al.

[11] Patent Number: 4,658,972

[45] Date of Patent: Apr. 21, 1987

[54] METHOD FOR STRETCHING AND FOLDING EXTENSION JIB IN WHEELED TYPE CRANE

[75] Inventors: Yukio Koizumi; Hiroshi Miyazawa, both of Akashi, Japan

[73] Assignee: Kabushiki Kaisha Kobe Seiko Sho, Kobe, Japan

[21] Appl. No.: 624,914

[22] Filed: Aug. 16, 1984

Related U.S. Application Data

[62] Division of Ser. No. 460,385, Jan. 24, 1983, Pat. No. 4,595,108.

[30] Foreign Application Priority Data

| | | | |
|---|---|---|---|
| Jan. 26, 1982 | [JP] | Japan | 57-11329 |
| Jan. 26, 1982 | [JP] | Japan | 57-11330 |
| Jan. 26, 1982 | [JP] | Japan | 57-11331 |
| Jan. 26, 1982 | [JP] | Japan | 57-11332 |
| Apr. 13, 1982 | [JP] | Japan | 57-61986 |
| Apr. 13, 1982 | [JP] | Japan | 57-61988 |
| Apr. 13, 1982 | [JP] | Japan | 57-61987 |
| Apr. 13, 1982 | [JP] | Japan | 57-61989 |
| May 18, 1982 | [JP] | Japan | 57-84448 |
| Jun. 18, 1982 | [JP] | Japan | 57-105892 |
| Jun. 18, 1982 | [JP] | Japan | 57-105891 |
| Sep. 21, 1982 | [JP] | Japan | 57-165795 |

[51] Int. Cl.[4] ..... B66C 23/04

[52] U.S. Cl. ..... 212/270; 52/111; 52/116; 212/264; 212/187; 212/230; 414/786

[58] Field of Search ..... 212/177, 182, 187–188, 212/230–232, 264, 266–269; 52/111, 115–117; 182/97, 101; 403/53, 74; 414/786; 340/685

[56] References Cited

U.S. PATENT DOCUMENTS

| | | | |
|---|---|---|---|
| 2,657,940 | 11/1953 | Davidson | 182/97 |
| 2,854,261 | 9/1958 | Spaide | 403/53 |
| 3,366,250 | 1/1968 | Grove | 212/188 |
| 3,698,569 | 10/1972 | Lamer et al. | 212/188 |
| 3,944,082 | 3/1976 | Fritsch | 212/187 |
| 4,052,602 | 10/1977 | Horn et al. | 340/685 |
| 4,091,936 | 5/1978 | Wuerflein et al. | 212/268 |
| 4,141,455 | 2/1979 | Henderson et al. | 212/188 |
| 4,222,491 | 9/1980 | Geppert | 340/685 |
| 4,303,165 | 12/1981 | Cassens et al. | 212/188 |
| 4,394,914 | 7/1983 | Privat | 212/268 |
| 4,431,109 | 2/1984 | Behrendt et al. | 212/177 |

FOREIGN PATENT DOCUMENTS

| | | | |
|---|---|---|---|
| 142170 | 6/1980 | German Democratic Rep. | 403/74 |
| 47706 | 6/1977 | Japan | 212/188 |
| 140348 | 10/1979 | Japan | 212/187 |
| 393090 | 6/1933 | United Kingdom | 403/53 |
| 401032 | 11/1933 | United Kingdom | 403/53 |

*Primary Examiner*—Trygve M. Blix
*Assistant Examiner*—R. B. Johnson
*Attorney, Agent, or Firm*—Oblon, Fisher, Spivak, McClelland & Maier

[57] ABSTRACT

A method for stretching and folding an extension jib in a wheeled type crane including a telescopic boom, and a suspension-rod-supported compression column type extension jib to be supported in a flat posture at the fore end of the boom in stretched state through right and left jib foot portions rotatably engaged with horizontal boom point pins extending transversely of the boom at the fore end thereof, the method including the steps of (a) providing on opposite sides of the extension jib right and left jib foot portions disengageably engageable with the boom point pins, one of the jib foot portions being rotatable relative to the boom about an axis extending in the axial direction of the jib; (b) stretching the jib from a folded position in which the top and bottom sides of the jib are disposed in an upright posture along one side of the boom, by engaging the one jib foot portion with the boom point pin on the folding side and turning the boom into an inclined position from a horizontal position, rotating the jib around the axis of the boom point pin into a vertically suspended position; (c) turning the jib in the vertically suspended position through a predetermined angle about the axis extending in the axial direction of the jib to engage the other jib foot portion with the corresponding boom point pin, and stretching the jib in a flat posture; and (d) in the folding operation, folding the jib into the initial folded position by performing steps (a) to (c) in an inverse order.

2 Claims, 27 Drawing Figures

METHOD FOR STRETCHING AND FOLDING EXTENSION JIB IN WHEELED TYPE CRANE

This is a divisional application of U.S. application Ser. No. 460,385 filed Jan. 24, 1983, now U.S. Pat. No. 4,595,108.

BACKGROUND OF THE INVENTION

1. Field of the Invention

This invention relates to a method for stretching and folding an extension jib in wheeled type cranes such as truck cranes, rough terrain cranes and the like.

2. Description of the Prior Art

Jibs to be attached to telescopic booms of wheeled cranes can be classified as truss cantilever jibs with a truss construction and suspension-rod-supported compression column type jibs (hereinafter referred to simply as "a truss type jib or a compression column type jib" for brevity), of which the compression column type jib is accepted as being advantageous from the standpoint of cost and weight. On the other hand, with regard to folding the extension jib, there is a down-folding type which holds the folded jib on the lower side of the boom and a side-folding type which holds the folded jib on one lateral side of the boom. The down-folding type has a problem that the range of vision of the operator especially the side view range is narrowed by the overlapped boom and jib during travelling operation of the vehicle. The range of sight can be broadened by raising the height of the crane which however gives rise to other problems in the travelling operations. The side-folding type has a broader view field of the operator in the lateral direction but it has an inherent problem in that the increase of dimension in the lateral direction makes it difficult to turn the machine on narrow tracks.

In order to secure at least a sufficient side view and maneuverability in a limited space, it has been the conventional practice to employ down-folding in the case of the compression column type jib to guarantee maneuverability in narrow spaces, and to employ side-folding in the case of the truss type jib to secure a sufficient side view range. In any event, there has been no fundamental solution to either one of the problems mentioned above.

When stretching and folding the jib, the side-folding type requires ample space on one side thereof since the jib has to be turned 180° in a horizonal plane. On the other hand, it is extremely troublesome to pass the main hook through the jib foot portion when stretching out the under-folding type jib.

SUMMARY OF THE INVENTION

With the foregoing situations in view, the present invention has as its object the provision of an apparatus for stretching and folding an extension jib of a wheeled type crane, reducing the dimensions in vertical and transverse directions when the jib is in a folded state to guarantee both a wide field of view in lateral directions and maneuverability in narrow spaces, permitting stretching and folding of the jib easily in narrow limited spaces.

The present invention basically concerns a compression column type side-folding jib, and its jist resides in a method in which the jib is folded on one side of the boom with the upper and lower sides of the jib turned into upright positions, and in the stretching operation the jib is turned in a vertically suspended state about an axis extending in the axial direction thereof to return the jib into the normal flat position.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
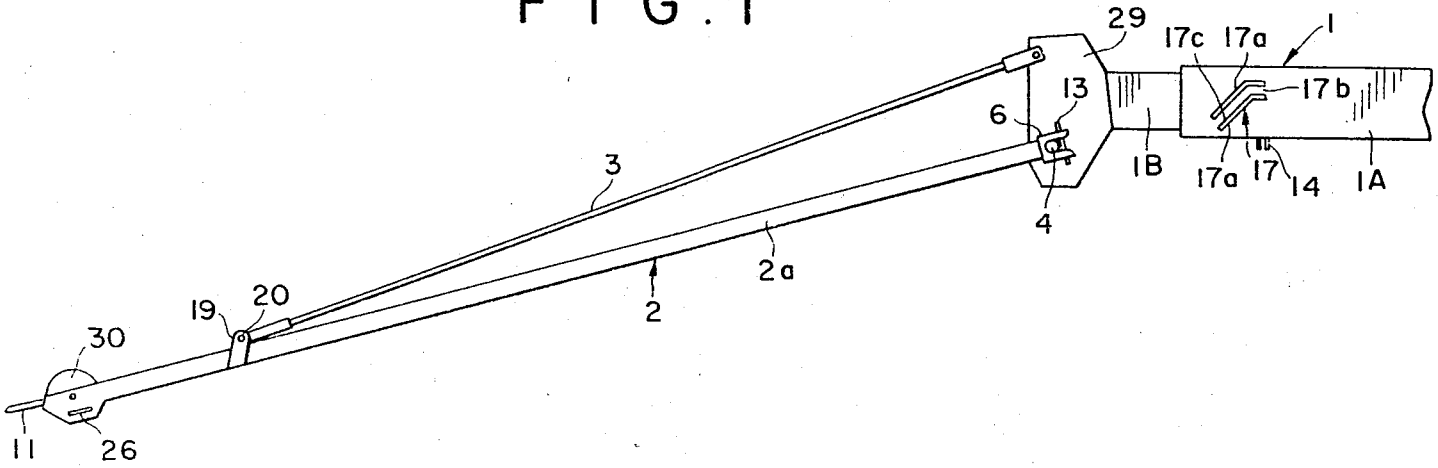
FIG. 1 is a side view of a stretched jib.
Figure 2:
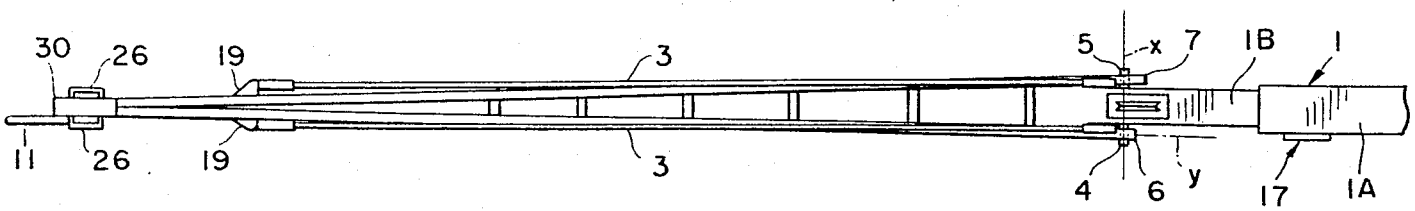
FIG. 2 is a plan view of the jib shown in FIG. 1.

Hereafter, the invention is described more particularly by way of some preferred embodiments with reference to the accompanying drawings.

Reference is firstly had to FIGS. 1 and 2 and FIGS. 3 and 4 which show a jib in stretched and folded states on a crane 1′, respectively, and in which indicated at 1 is a telescopic boom, at 2 is a compression column type jib supported by suspension rods (hereinafter referred to simply as "jib" for brevity), and at 3 are suspension rods. In these figures, the telescopic boom 1 is shown as a single extension type consisting of extendable rear and fore boom sections 1A and 1B for simplicity of explanation and powered in a conventional manner, but of course the present invention is also applicable similarly to double- or triple-extension type booms utilizing a conventional lifting device 1". It should also be understood that the terms "right" and "left" which appear in the following description are directions as seen from the driver's seat. As well known, the jib 2 is in the form of a flat forwardly converging frame including a pair of side bars 2*a* and 2*b* of flat square pipes and a multitude of transverse connecting bars 2*c* of similar flat square pipes.

Provided at opposite sides of the distal end of the boom 1, namely, the distal end (the boom point) of the fore boom section 1B are boom point pins 4 and 5 which are rotatable about an axis x an engageable with left and right jib foot portions 6 and 7 of the jib 2 when in the stretched state. The boom point pins 4 and 5 may be constituted by a single pin which is passed transversely through the fore end portion of the boom or by a couple of pins which are attached separately to the opposite sides of the fore end portion of the boom. The left and right foot portions 6 and 7 of the jib are each formed in a bifurcated shape. More precisely, the left foot portion 6 of the jib is in the form of a bifurcated fork with fingers of the same length, while the right foot portion 7 of the jib is in the form of a bifurcated fork with fingers of different lengths. These foot portions 6 and 7 of the jib 2 are formed separately from the body of the jib proper, more particularly, from the side bars 2*a* and 2*b*. The right foot portion 7 is fixedly secured to the base end of the right-hand side bar 2*b*, and the left foot portion 6 is integrally provided with a male screw portion 6*a* as shown in FIG. 5*a*, with the male screw portion 6*a* threaded into a tapped socket 6*b* which is securely fixed in the base end portion of the left-hand side bar 2*a*. Thus, the left foot portion 6 is rotatable relative to the base end of the left-hand side bar 2*a* about the axis thereof.

Figure 5B:
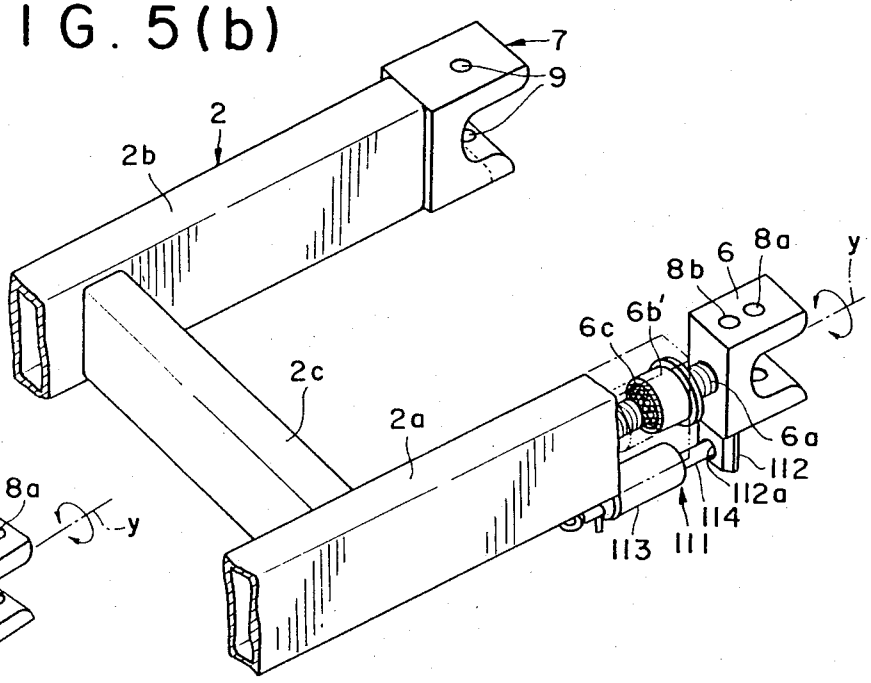
FIGS. 5*a* and 5*b* are enlarged perspective views, respectively, of different jib foot portions.
Figure 5A:
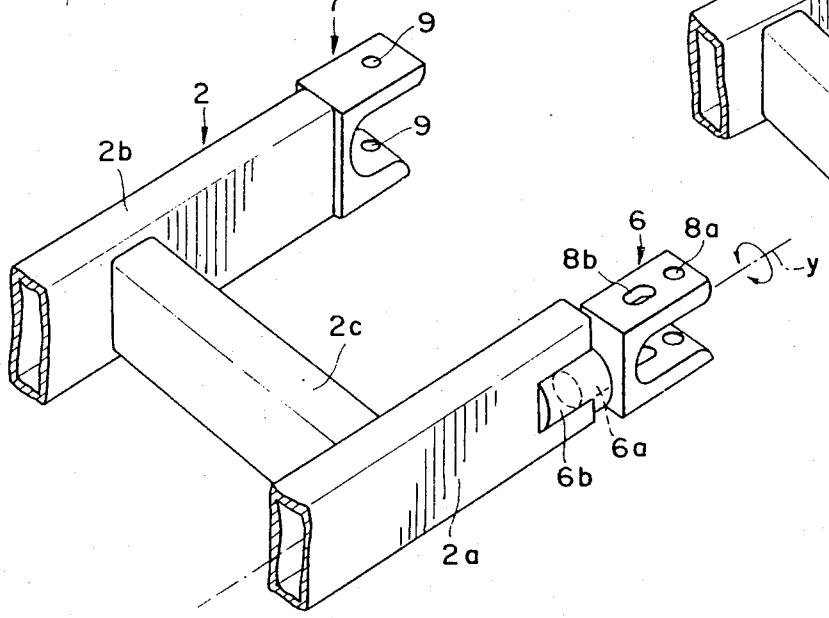
Figure 6:
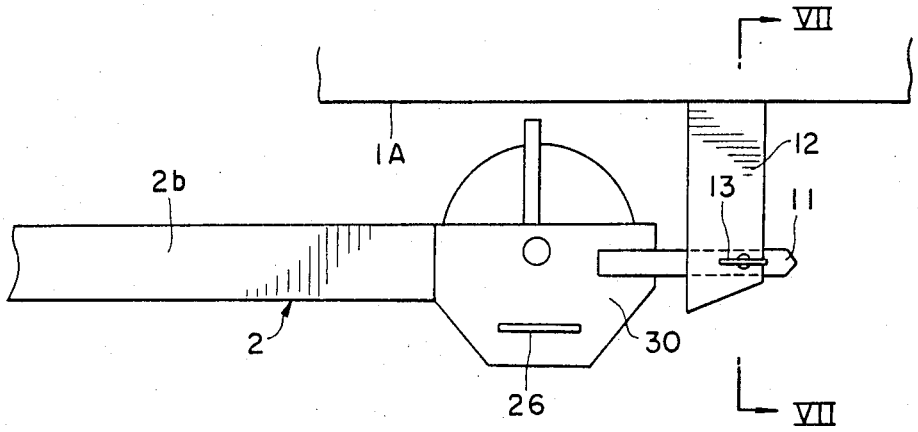
FIG. 6 is an enlarged view of the encircled portion A in FIG. 4.
Figure 7:
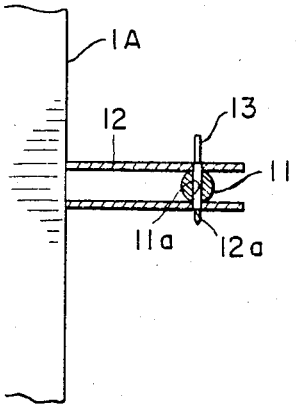
FIG. 7 is a sectional view taken on line VII—VII of FIG. 6.

Instead of the combination of the male screw portion 6*a* and the socket 6*b*, the foot portion 6 of the jib may be rotatably fixed to the base end of the left-hand side bar 2*a* through a ball screw which as shown particularly in FIG. 5(*b*) consists of a screw shaft 6*a*, an internally tapped cylinder 6*b*' and a multitude of balls 6*c* interposed therebetween. With this arrangement, as the ball screw has a small rotational force, the jib can be rotated easily under its own weight or by lifting it up with a small force.

The right foot portion 7 is provided with a pin slot 9 at one position thereof, while the left foot portion 6 is provided with a couple of pin slots 8*a* and 8*b* at its fore end and middle portions, respectively. The pin slot 8*b* in the middle portion of the left foot portion 6 is formed in an elongated form. The left and right boom point pins 4 and 5 are also provided with pin slots 4*a* and 5*a* radially through the respective bodies.

Figure 3:
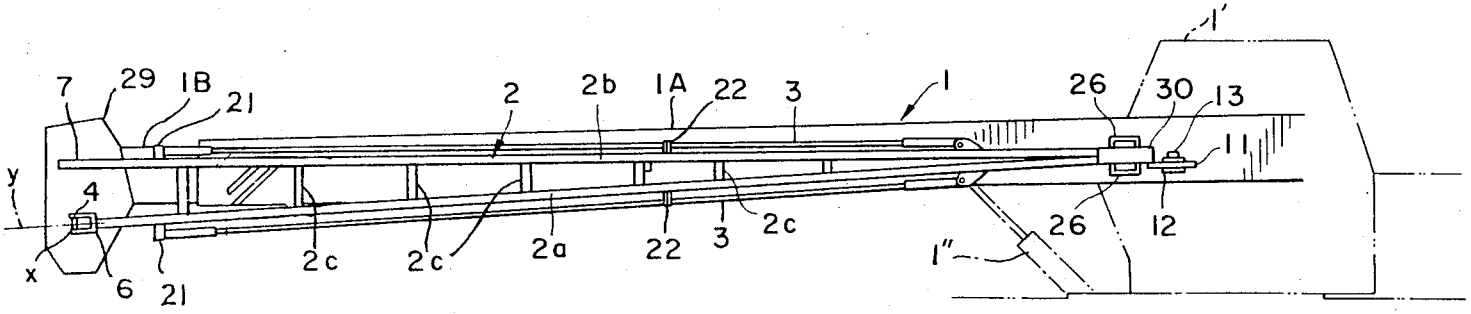
FIG. 3 is a side view of the jib in a folded state.
Figure 4:
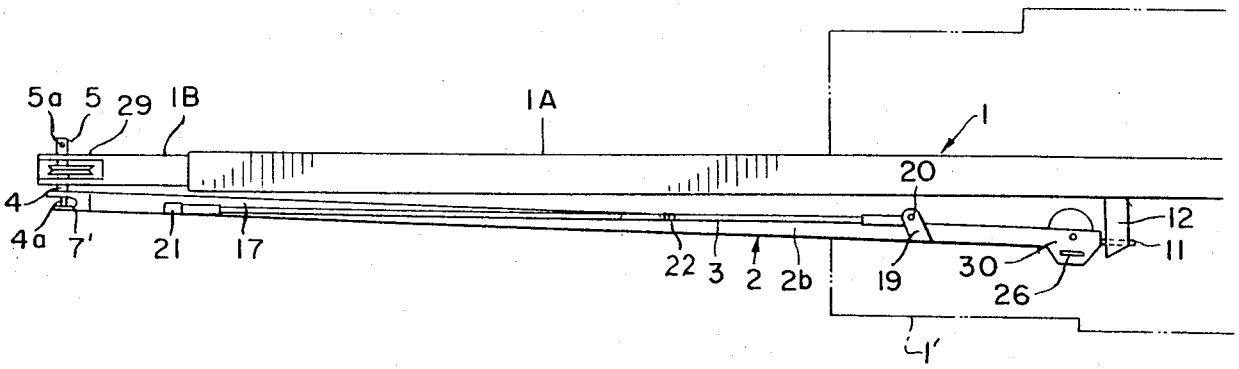
FIG. 4 is a plan view of the folded jib.

As shown particularly in FIGS. 3 and 4, the jib 2 is folded such that its top and bottom sides are disposed upright along the jib folding side of the rear section 1A of the boom. In the folded state, the jib 2 is fixed to the rear section 1A of the boom 1 at its fore end and base portions. More specifically, for the fixation of the fore end portion of the jib, a lock pin 11 protrudes axially from the fore end of the jib 2 and engages with a sleeve-like bracket 12 which projects from the left side of an end portion of the rear boom section 1A, as seen in FIGS. 1 to 4, 6 and 7. The bracket 12 and locking pin 11 are provided with pin slots 12*a* and 11*a* which are vertically aligned with each other when the jib is folded, and an end fixing pin 13 is inserted into the pin slots 12*a* and 11*a* to fix the locking pin 11 in the bracket 12. On the other hand, for fixation of the base end portion of the jib, the rear boom section 1A and the left-hand bar 2*a* of the jib are provided with brackets 14 and 15 which are fixable to each other by insertion of a base fixing pin 16 in the locking holes formed in the respective brackets as shown particularly in FIG. 9.

Figure 8:
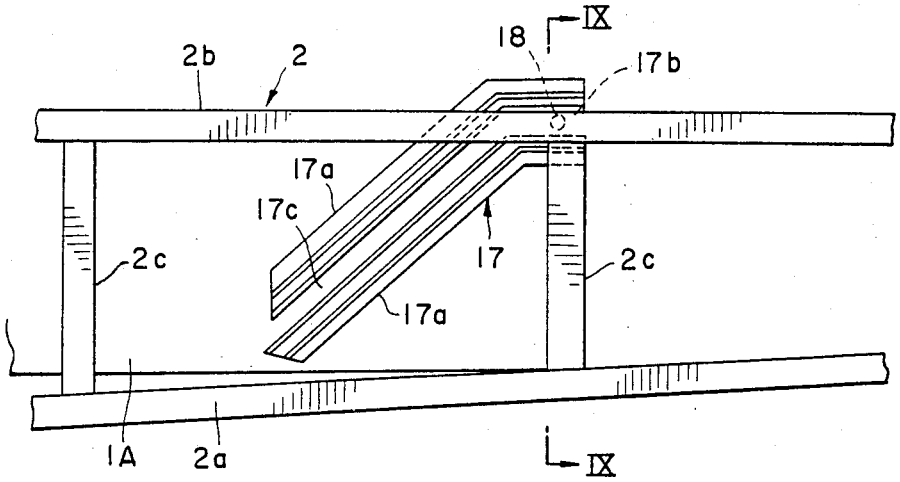
FIG. 8 is an enlarged view of the encircled portion B in FIG. 3.
Figure 9:
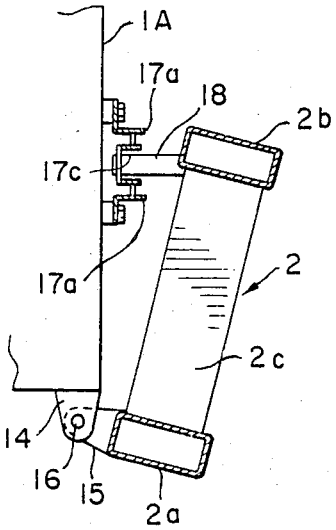
FIG. 9 is a sectional view taken on line IX—IX of FIG. 8.

Indicated at 17 is a jib guide which is, as shown in FIGS. 8 and 9, formed of a pair of parallel guide frames 17*a*, 17*a*' which are securely fixed to the left side of the fore end portion of the rear boom section 1A. The jib guide 17 consists of a horizontal portion 17*b* extending in the axial direction of the boom and a forwardly inclined or sloped portion 17*c*. Designated at 18 is a guide pin or a guide roller which is projectingly provided on the right-hand bar 2*b* for engagement with the jib guide 17. The jib guide 17 prevents disengagement of the guide pin 18.

Figure 10:
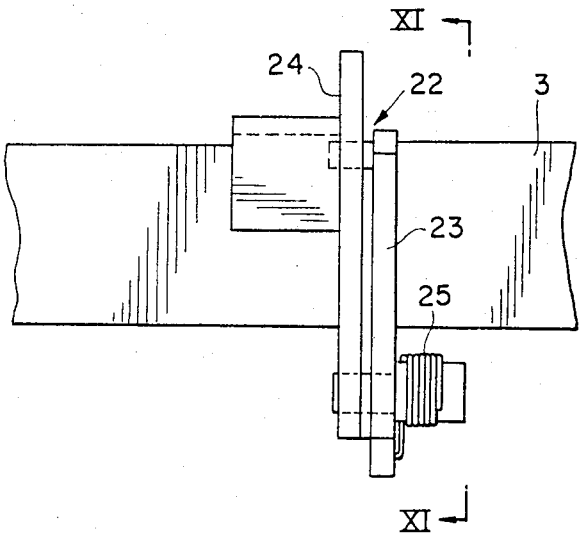
FIG. 10 is an enlarged view of the rod receptacle in FIG. 4.
Figure 11:
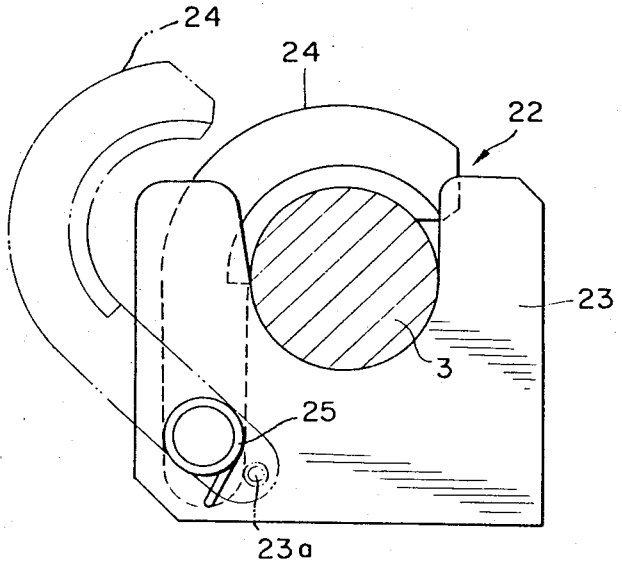
FIG. 11 is a sectional view taken on line XI—XI of FIG. 10.

Reference numeral 19 denotes suspension rod mounting seats which are upwardly projected from the left and right bars 2*a* and 2*b* in the fore end portion of the jib 2. When the jib is in use or in a folded state, end portions of the suspension rods 3 are fixed to the mounting seats 19 by pins 20. In order to stow away the suspension rods 3 on the jib 2 after folding the latter, L-shaped rod receptacles 21 are provided at the left and right sides of the rear section of the jib 2 along with rod holders 22 which are provided at the left and right sides of the middle portion of the jib 2. As shown particularly in FIGS. 10 and 11, the rod holders 22 each constitute a U-shaped holder body 23, a flap link 24 which opens and closes the upper open side of the holder body 23, and a torsion coil spring 25 which constantly urges the link 24 in the direction of closing the holder body 23. When stowing away the rods, the holder bodies 23 are closed by the respective flap links 24 to retain the rods 3 therein, freeing the rods 3 by opening the flap links 24 when the rods are to be used. Indicated at 23*a* is a retainer pin which holds the flap link 24 in open state, and at 26 are jib twisting handles which are provided at the left and right sides of the fore end portion of the jib 2.

The description is now directed to the operations for stretching and folding the jib 2 according to the present invention.

When in the folded state shown in FIGS. 3 and 4, the jib 2 is extended along the left side of the rear boom section 1A in an upright position, with the right-hand bar 2*b*, which is on the right side in the stretched state, being positioned over the left-hand side bar 2*a*. In this state, the aforementioned pin 11 at the fore end of the jib is inserted into the bracket 12 at the base end of the rear boom section 1A and then fixed to the latter by the jib end fixing pin 13, while at the base end, the brackets 14 and 15 are fixed to each other by the base fixing pin 16, thereby fixing the jib 2 in the folded position. At this time, the jib 2 is supported in position by the engagement of the guide pin 18 with the jib guide 17 in addition to the engagement of the left foot portion 6 of the jib with the left-hand boom point pin 4. The jib 2 which is held in the folded position in this manner is stretched out in accordance with the following steps.

(A) After stabilizing the machine by extending out the outrigger (not shown) of the crane, the boom 1 is fully contracted and turned sideward or rearward substantially in a horizontal posture.

Figure 13:
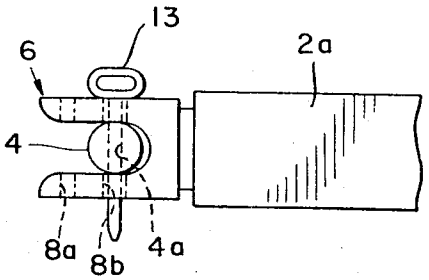
FIG. 13 is an enlarged view of the left-hand jib foot portion in the same preparatory state.
Figure 12:
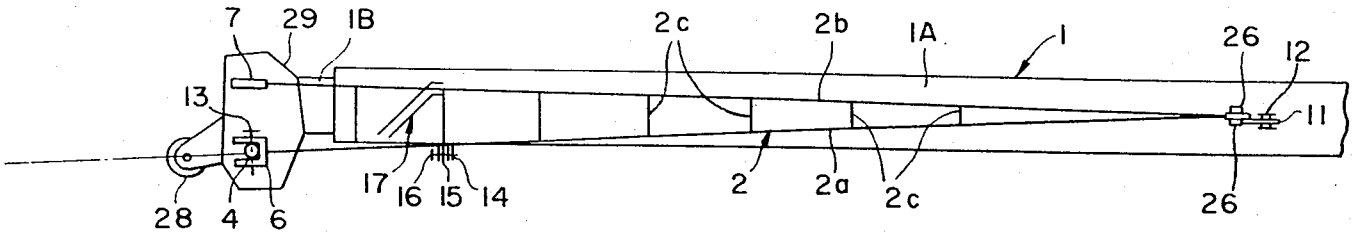
FIG. 12 is a schematic side view of the jib preparatory for the stretching operation.

(B) With reference to FIGS. 12 and 13, the end fixing pin 13 at the distal end of the jib is removed from right foot portion 7, pushing the pin 13 into the pin slot 4*a* in the left boom point pin 4 and the intermediate pin slot 8*b* of the left jib foot portion 6. As a result, the left jib foot portion 6 and boom point pin 4 are connected to each other, utilizing the end fixing pin 13 as a jib foot pin.

(C) The base fixing pin 16 of the jib is removed. The removed pin 16 is used afterwards as a foot pin for the right jib foot 7.

Figure 14:
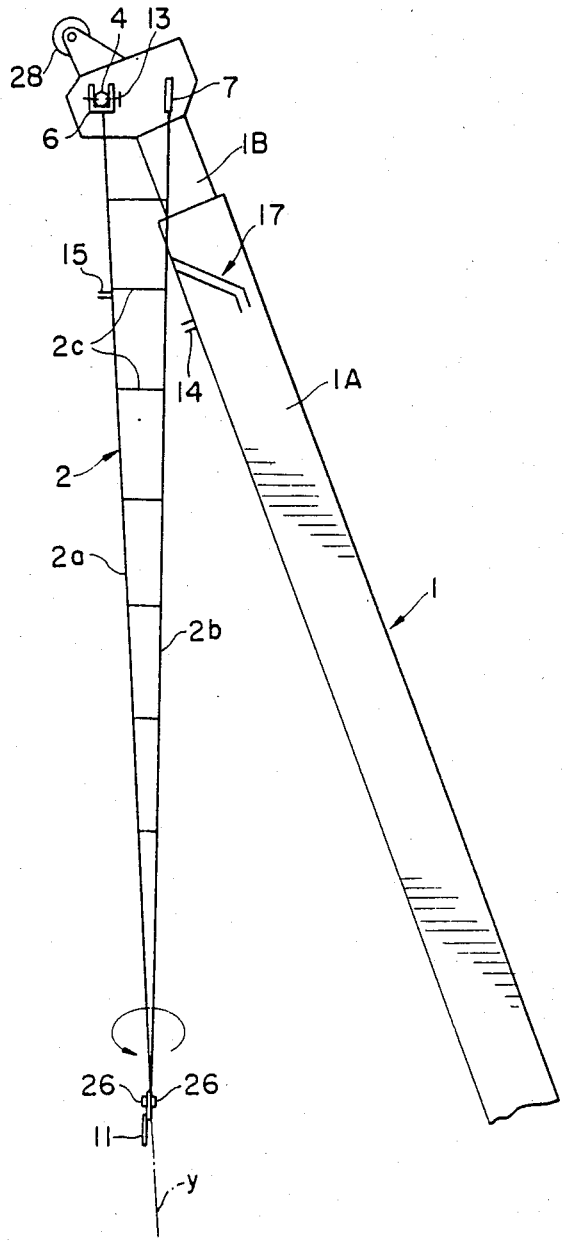
FIG. 14 is a schematic side view of the jib which is suspended in a vertical position.

(D) The boom 1 is then turned up to a position of, for example, 80° as shown in FIG. 14, and stretched out until the guide in 18 is disengaged from the jib guide 17, whereupon, the jib 2 is slowly turned forward about the axis of the boom point pins 4 and 5 away from the rear boom section 1A, taking a vertical position.

(E) The boom 1 is moved down to lower the handles 26 at the fore (lower) end of the jib to a level suitable for manipulaton from the ground.

Figure 15:
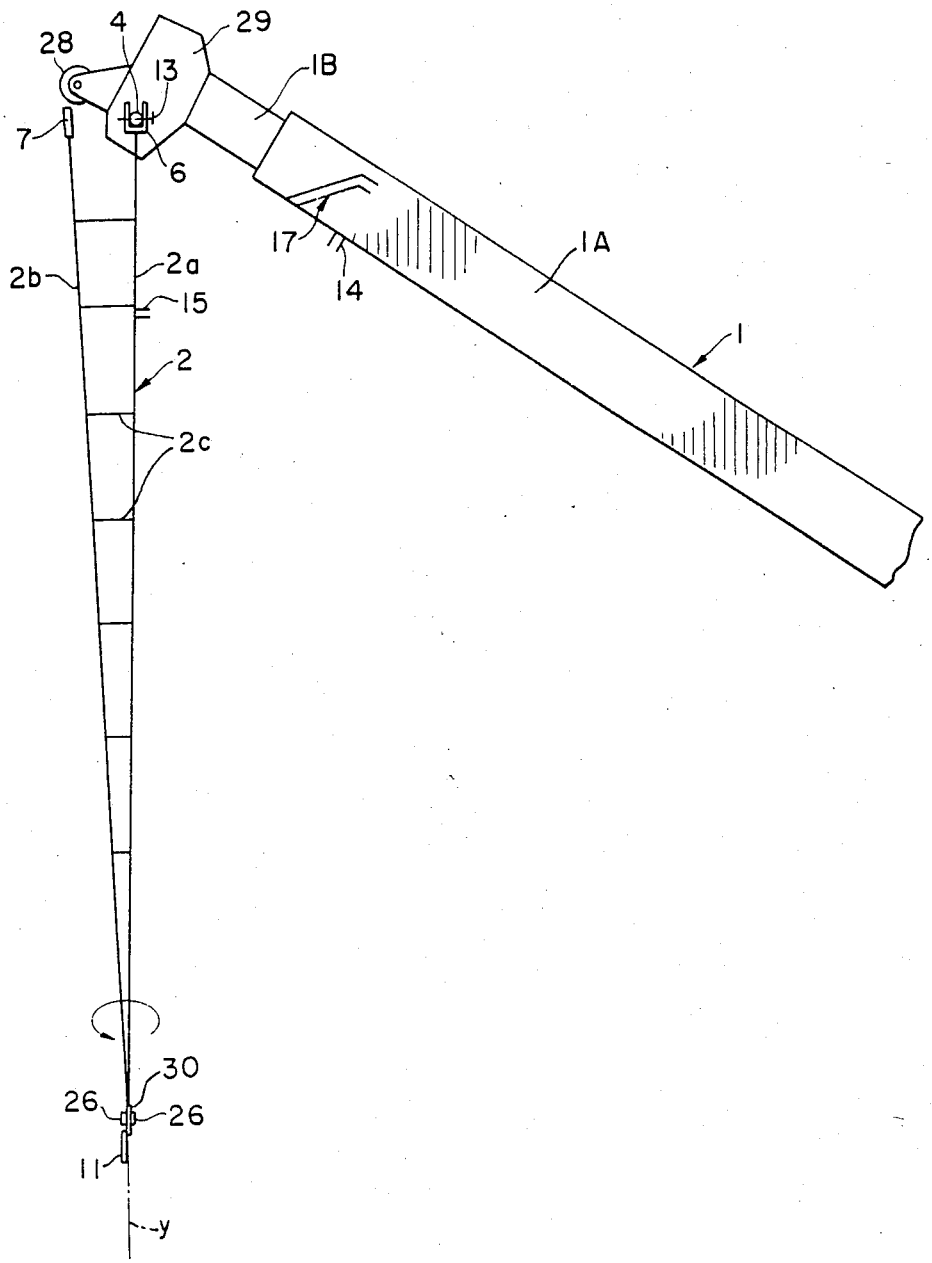
FIGS. 15 and 16 are schematic side views of the same jib in FIG. "14" but which has been rotated by 180° and 90°, respectively.
Figure 16:
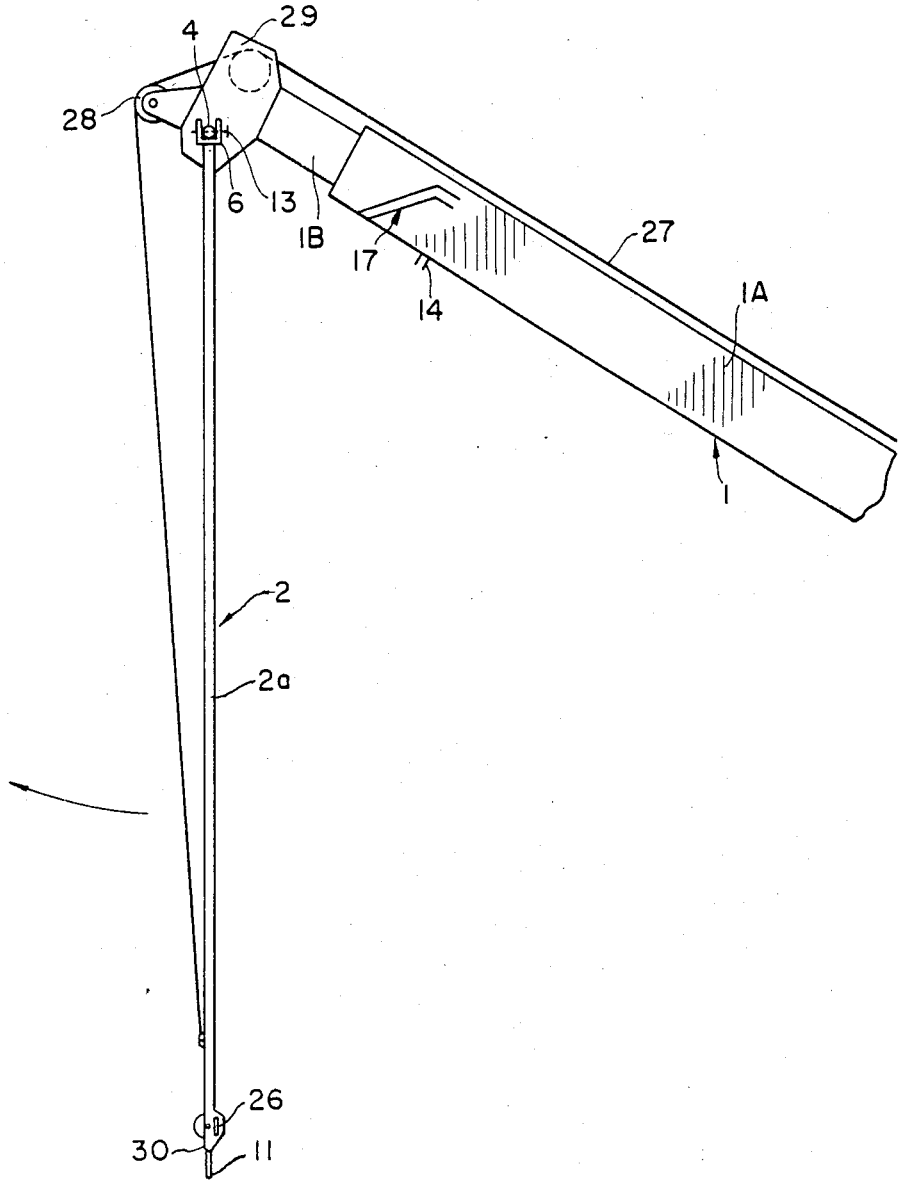

(F) Manually gripping the handles 26, the jib 2 is twisted for rotation about the axis y of the jib (the vertical axis) approximately 270° (from the position of FIG. 14 to FIG. 16) to engage the right jib foot 7 with the right boom point pin 5.

As the jib 2 is twisted and set at the fore end of the boom, the base portion of the jib can easily evade the main block (not shown) which is suspended immediately beneath the sheave 29 at the distal end of the boom. Alternatively, if the main hook is lowered to the ground beforehand, it suffices to evade the suspension wire of the main hook, without the problem of passing the main hook through the base end of the jib as experienced in the stretching operation of the aforementioned down-folding type jib.

(G) The distal end of the auxiliary hoist wire 27 which is passed through the auxiliary sleeve 28 of the fore boom section 1B is fixed to the fore end portion of the jib 2, and the boom 1 is further turned downward until the fore end of the jib reaches a level of about 1 m from the ground surface while winding up the auxiliary hoist wire 27, or the boom 1 is turned down while extending out the fore boom section 1B.

Figure 17:
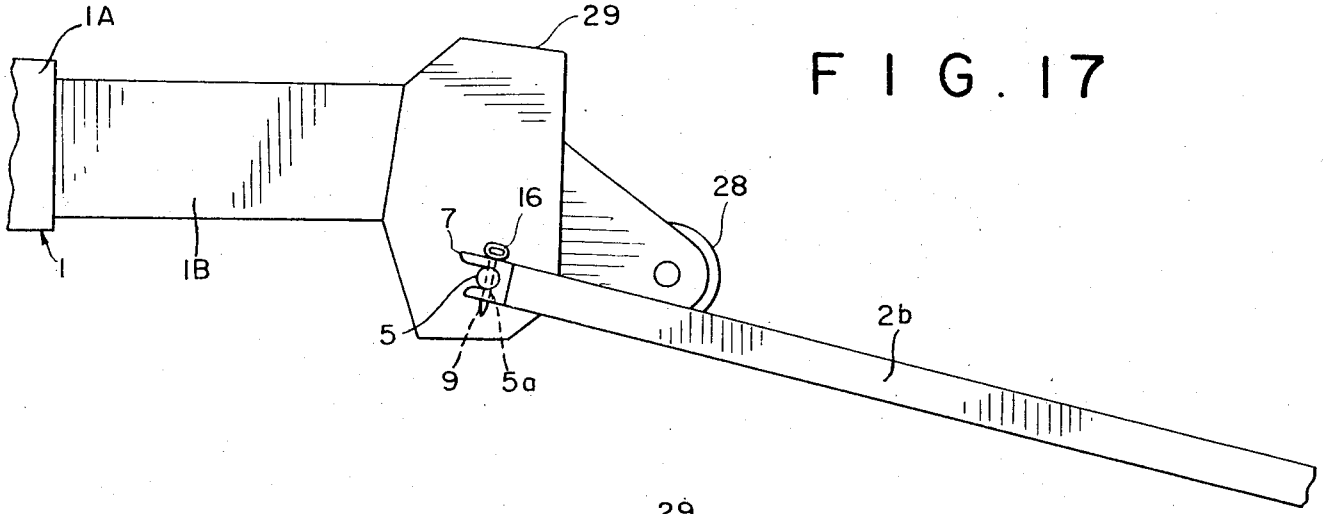
FIGS. 17 and 18 are side views of foot portions of the jib which is set in the stretched serving position.
Figure 18:
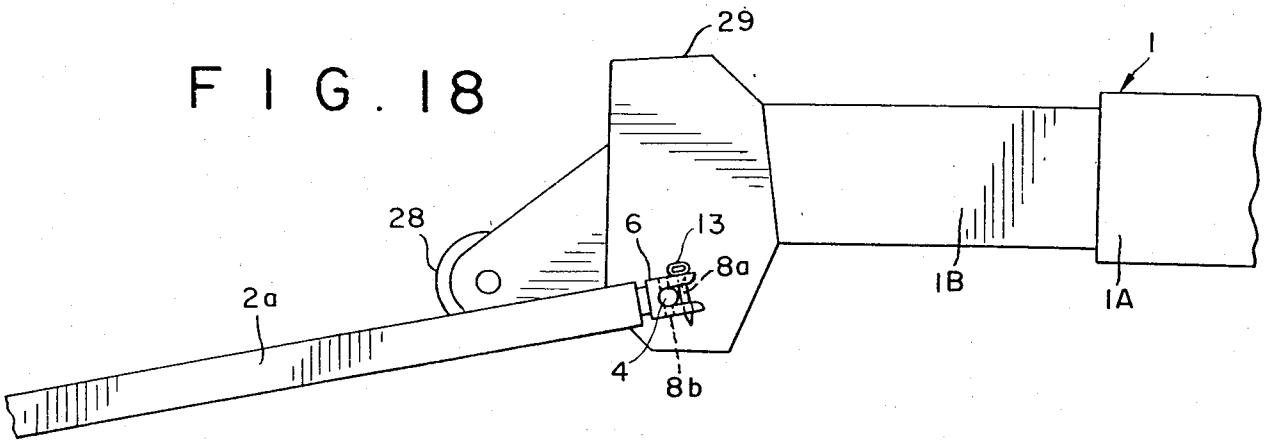

(H) After turning boom 1 in a horizontal position or a slightly inclined position, the jib base fixing pin 16, which was removed in step (C), is inserted into the pin slot 9 of the right jib foot 7 and the pin slot 5*a* of the right boom point pin 5 as shown in FIG. 17 to prevent disengagement of the jib foot 7 from the boom point pin 5. Then, the jib end fixing pin 13 which was inserted into the pin slots 8*b* and 4*a* of the left jib foot 6 and the left boom point pin 4 is extracted therefrom, and instead inserted into the pin slot 8*a* at the fore end of the jib foot 6 as shown in FIG. 18. In this replacement of the pin 13, such can be easily extracted since the intermediate pin slot 8*b* of the left jib foot 6 is elongated. Thus, when the jib is in the stretched state, the left jib foot 6 is intimately contacted with the left boom point pin 4.

Figure 19:
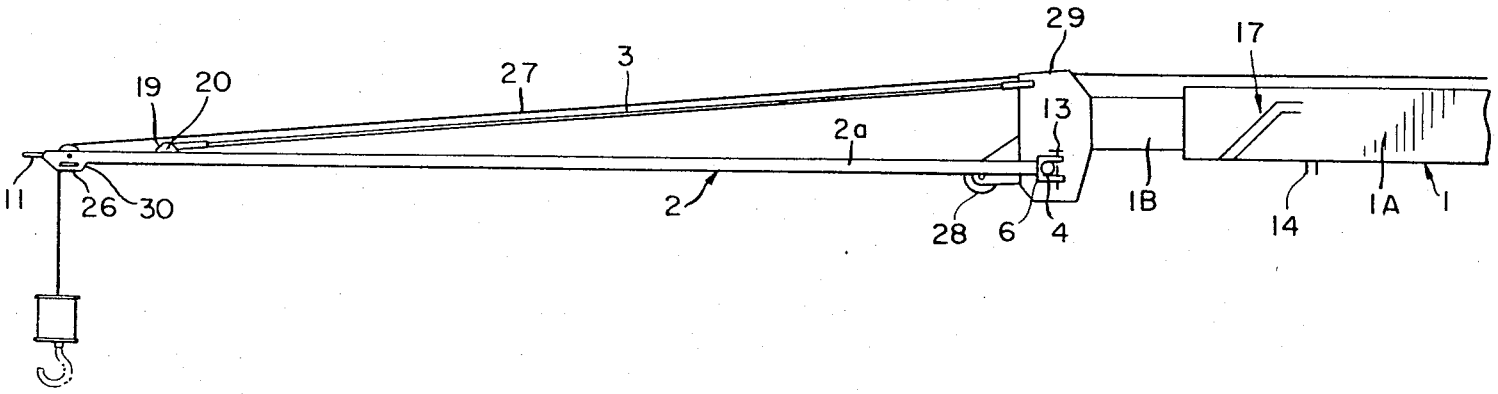
FIG. 19 is a schematic side view of the jib which has completed the stretching operation.

(I) The base and intermediate portions of the suspension rods 3 are removed from the rod receptacles 21 and rod holders 22, and the base ends of the rods are attached to the sheave block 29 of the fore boom section 1B as shown in FIG. 19, bridging the suspension rods 3 between the jib 2 and the fore boom section 1B thereby to support the jib.

(J) The auxiliary hoist wire 27 is passed through the sheave block 30 of the jib 2, attaching an auxiliary hook 31 to the fore end of the wire.

Now, the extension of the jib 2 is completed.

In order to fold the jib 2, the above-described steps are performed in an inverse order. To summarize the folding operation, the boom 1 is turned downward to a horizontal or a slightly inclined position and contracted to a length slightly greater than its fully contracted length, for example, to a length of 60–70 cm. Then, after removing the auxiliary wire 27 from the auxiliary hook 31, the wire end is attached to the fore end of the jib, and the rods 3 are removed and stowed on the jib 2 which is supported by the auxiliary wire. The jib end fixing pin 13 which has been used as a left jib foot pin is relocated in a manner inverse to the step (H) of the stretching procedures, and the jib base fixing pin 16 is removed from the right jib foot 7. In the next step, the auxiliary hoist wire 27 is loosened by raising the boom 1, or the fore boom section 1B is contracted after extending the same outwardly about 2 m, thereby turning the jib 2 downward into vertical position. After removing the auxiliary hoist wire 27, the jib 2 is turned approximately 270° about the axis y, and then raised to an angle of about 80°. By so doing, the guide pin 18 of the jib 2 reaches a position opposing the jib guide 17 of the rear boom section 1A, so that it is received in the jib guide 17 of the rear boom section 1A upon contraction of the boom 1, and the jib 2 is automatically urged toward the left side of the boom 1A as the boom is contracted and finally folded into the position shown in FIGS. 3 and 4. The jib 2 is fixed in the folded state by setting the end and base fixing pins 13 and 16 in their respective positions.

Figure 25A:
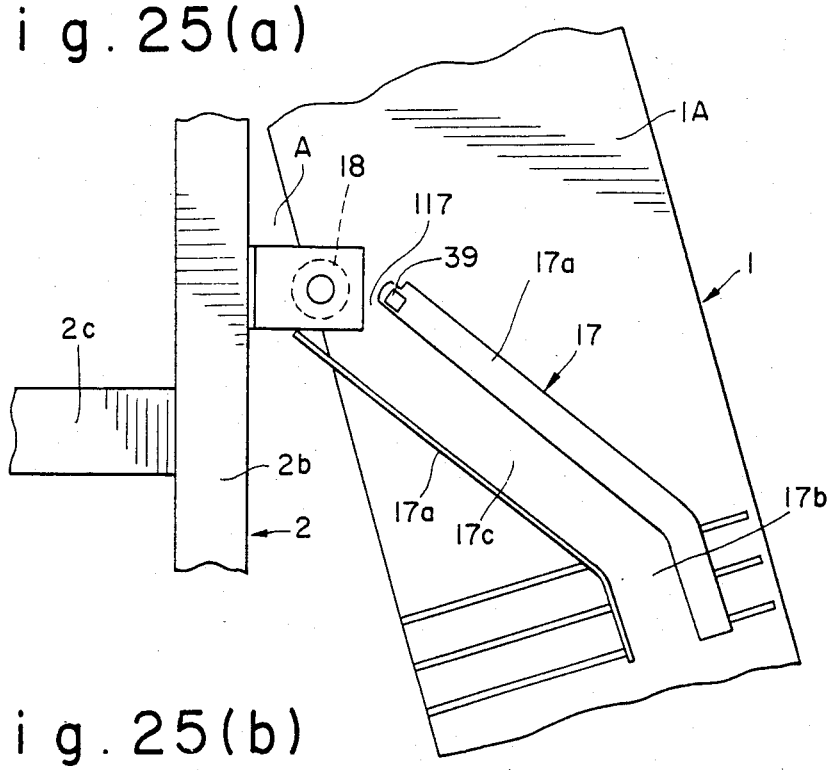
FIGS. 25(*a*) and 25(*b*) are side views of a jib guide mechanism in jib stretching and folding operations, respectively.
Figure 25B:
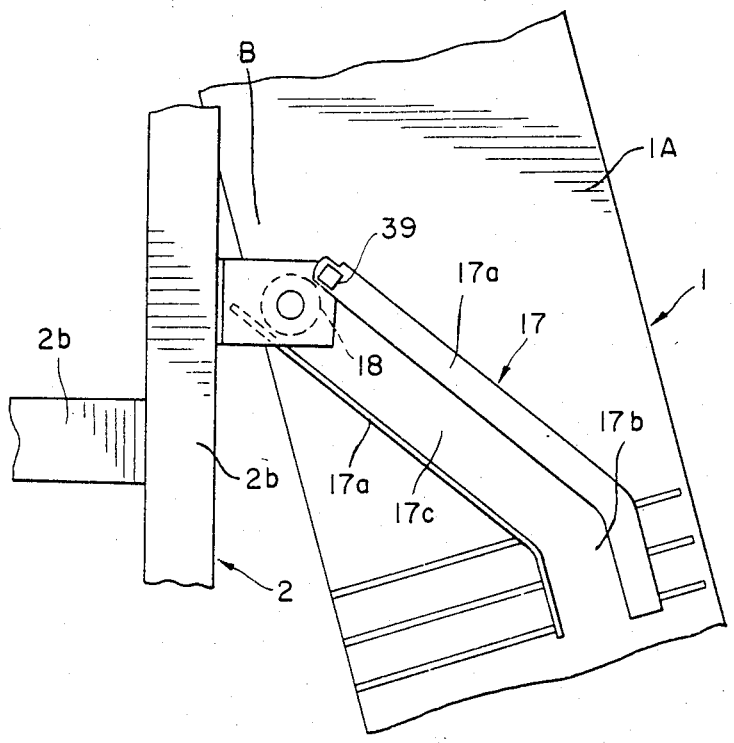

In this instance, in the step of turning the jib 2 through 270° from the flat vertical position, it is preferred to employ the preset mechanism 111 shown in FIG. 5(*b*) for turning the jib more accurately into a position conforming with the folding posture. In the particular example shown in FIG. 5(*b*), the preset mechanism includes brackets 112 and 113 which are securely fixed on the left jib foot 6 and the jib body 2*a*. Bracket 113 is provided with a pin 114 and a spring (not shown) which presses the pin 114 against the bracket 112, while the bracket 112 is provided with a pin slot 112*a*, which is engageable with the pin 114. Namely, by the engagement of the pin 114 and the pin slot 112*a*, the jib 2 is stopped at a position suitable for folding, so that it can be set in the folding posture in a facilitated manner. In the step of folding the jib which is set in the folding posture, the length and angle of the boom 1 are adjusted to bring the guide pin or roller 18 of the jib 2 into a position opposing an opening 117 at the fore end of an inclined groove 17*c* of the jib guide 17 as shown in FIG. 25(*a*). Upon contracting the boom 1B in this state, the roller 18 is moved into the inclined groove 17*c* and horizontal groove 17*b* to set the jib in the folded state as shown in FIG. 25(*b*).

For the purpose of facilitating the engagement of the guide pin or guide roller 18 with the inclined groove 17*c*, there may be provided a catch mechanism (not shown) in the vicinity of the opening 117 at the fore end of the inclined groove 17*c* for receiving and guiding the pin or roller 18 toward the opening 117. Further, arrangements may be made to provide a signal to the driver as soon as the guide pin or roller 18 reaches a position opposing the opening 117 at the entrance of the guide groove by the following method to facilitate the folding and unfolding operations. For example, the length and angle which are assumed by the boom 1 when the roller 18 reaches the position "A" of FIG. 25(*a*) as well as the length and angle which are assumed by the boom 1 when the roller 18 reaches position "B" of FIG. 25(*b*) are preset in an arithmetic operation of a monitor device, which is adapted to provide a signal (or indication) to the driver as soon as the length and angle of the boom which are detected by length and angle detectors becomes equal to the preset values.

As is clear from the foregoing description, the jib 2 is folded with its upper and lower sides disposed vertically along one side of the boom 1 according to the method of the present invention, so that the transverse dimension of the folded boom and jib can be reduced to a minimum although the jib is a side-folding type. Of course, the vertical dimension in the folded state is limited so as to be substantially as small as that of the boom 1. It follows that the jib ensures a wide range of side view as well as the operationability in narrow spaces.

Besides, in the stretching and folding operations, the vertically disposed jib 2 is twisted about the vertical axis y for changing its posture from an upright position (folding position) to the horizontal position (extending position) or vice versa. Accordingly, there is no need for securing a broad jib turning space which is necessary in the case of the conventional side-folding jib, permitting extension and folding of the jib in a narrow place.

Figure 20:
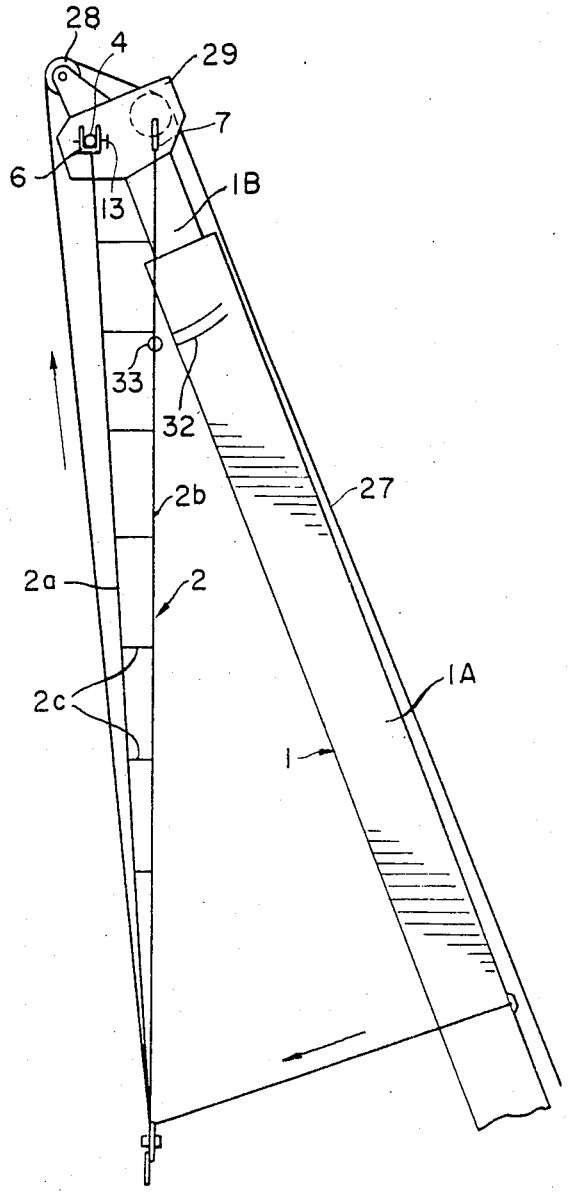
FIG. 20 is a schematic side view employed for the explanation of another embodiment of the invention.

Next considering then the second embodiment, it is to be noted in the foregoing first embodiment, the jib 2 is guided into and out of the upright posture lying along one side of the boom 1 by means of the guide mechanism constituted by the jib guide 17 on the boom 1 and the guide pin 18 on the jib 2 in addition to the telescopic movements of the boom 1. This operation can also be performed by the use of the auxiliary hoist wire 27 as shown in FIG. 20. More particularly, the auxiliary hoist wire 27 is passed through the fore end of the jib 2 at the time of jib extension, fixing the wire end to the rear boom section 1A, and, while holding the boom 1 at an angle smaller than 80°, the auxiliary wire 27 is loosened to lower the jib 2 into a vertically suspended position by gravity. This operation is inverse to the jib folding operation, pulling the vertically disposed jib 2 toward the boom 1 by winding up the auxiliary hoist wire 27. Indicated at 32 is a jib guide which is provided on the rear boom section 1A arcuately along the rotational locus of the jib 2, and at 33 is a guide pin which is engageable with the jib guide 32. In this embodiment, the bracket for holding the fore end of the jib is formed in a box-like shape which is open on the bottom side thereof.

Figure 21:
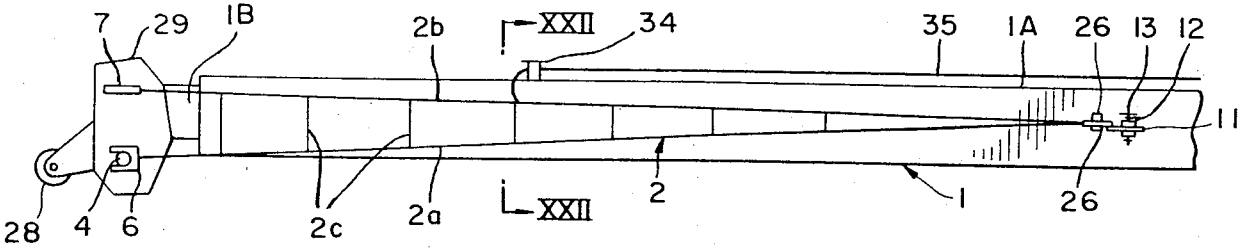
FIG. 21 is a schematic side view employed for the explanation of still another embodiment of the invention.
Figure 22:
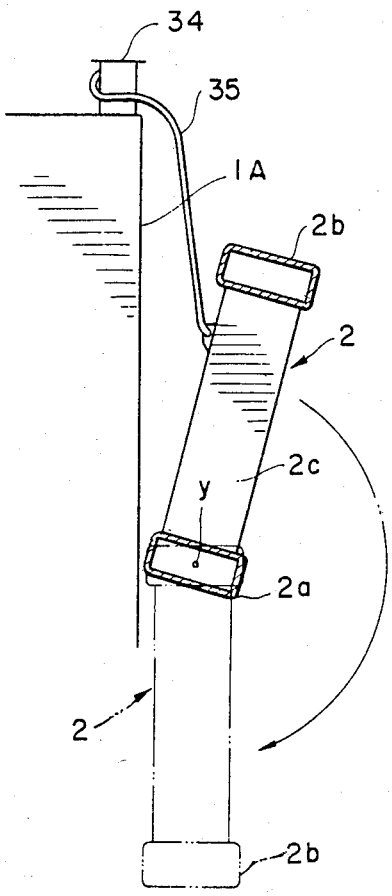
FIG. 22 is an enlarged sectional view taken on line XXII—XXII of FIG. 21.
Figure 23:
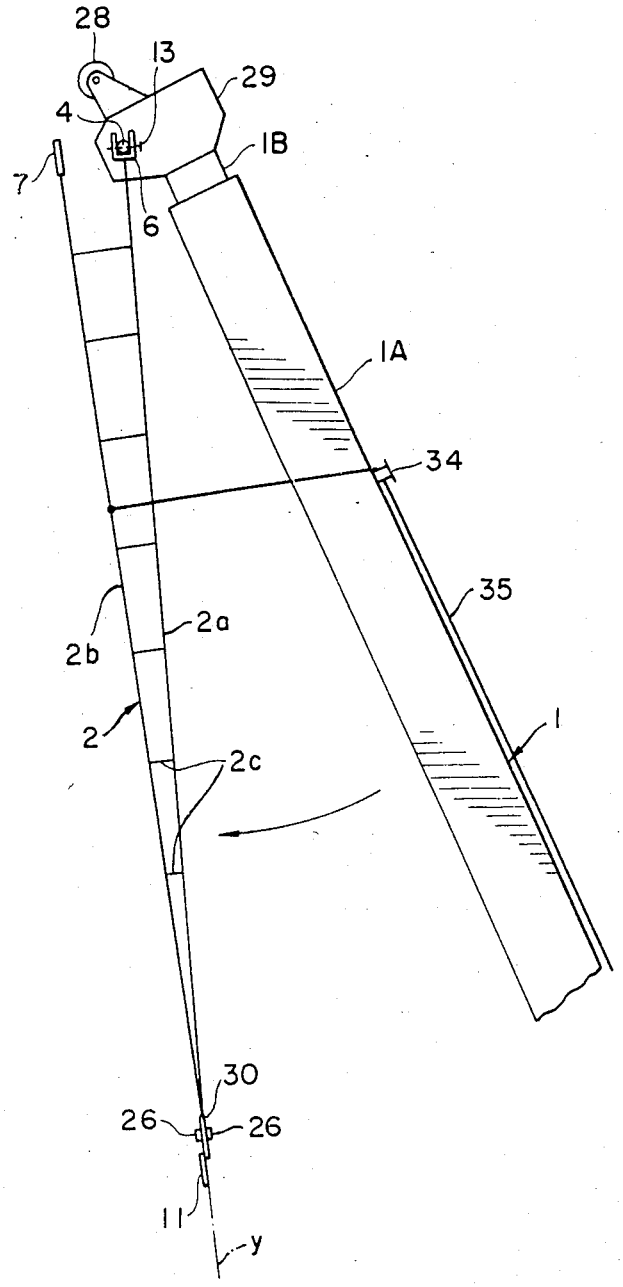
FIG. 23 is a schematic side view of the jib which has been swung into the vertical position.

FIGS. 21 and 22 illustrate a third embodiment of the present invention, wherein the boom 1 is held in a fully contracted horizontal position at the time of jib extension, attaching to the jib 2 the fore end of an extending wire 35 which is pulled out from a manual winch (not shown) through a sheave or a drum 34 which is mounted on the boom 1. In this state, the end fixing pin 13 of the jib is removed and used as a jib foot pin for the left jib foot 6 in the same manner as in the first embodiment, and the extension wire 35 is loosened to rotate the jib 2 180° about the axis y as indicated by the imaginary line in FIG. 22. Thereafter, the boom 1 is raised to an angle of about 80° and the boom 1 is simultaneously extended while loosening the extension wire 35, and the lock pin 11 at the fore end of the jib 2 is extracted from the bracket 12 of the rear boom section 1A. Then, the extension wire 35 is further loosened to suspend the jib 2 in a vertical posture as shown in FIG. 23, and in this state, the jib 2 is rotated again approximately 90° about the axis y to engage the right jib foot 7 with the right boom point pin 5. Thus, in this third embodiment the jib 2 is preliminarily twisted by 180 before swinging the same into the vertical position.

If the jib is of small size and weight as in the case of rough terrain cranes, it is possible to move the jib 2 from the folded position to the vertically suspended position or vice versa by manual labor. In such a case, the jib extending and folding operations are simplified all the more.

Figure 24:
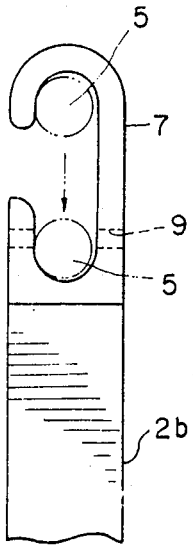
FIG. 24 is a side view of a right jib foot portion of a modified construction.

Although the left foot 6 of the jib 2 is rotated about the axis y by means of screw rotation in the above-described embodiment, there may be employed a bearing mechanism instead of the screw rotation mechanism if desired. The right jib foot 7, which has been described as being of a bifurcated form with fingers of different lengths in the foregoing embodiments, may be formed generally in C-shape having one of the bifurcated fingers bent in inversed L-shape as shown in FIG. 24. The right jib foot 7 of this shape is hooked on the right boom point pin 5 when the jib 2 is twisted in the vertically suspended state, as the jib 2 foot 7 beneath the right boom point pin 5 by gravity, temporarily establishing a connection between the right boom point pin 5 and the right jib foot 7. Even though the engagement of the right jib foot 7 with the boom point pin 5 is facilitated in the situation where the right jib foot 7 is of stepped form as in the first embodiment, the aforementioned objective of the present invention can be achieved to a satisfactory degree when the bifurcated right jib foot has fingers of the same length as that of the left jib foot.

It will be appreciated from the foregoing description that the crane according to the present invention can fold the jib on the boom in such a manner as to reduce the transverse dimension to a minimum although it is a side-folding type, to ensure a good side field of view inherent to the side-folding type along with good maneuverability in narrow spaces. In addition, the jib stretching and folding operations can be performed easily in a narrow space. In the jib stretching operation, there is non necessity of taking the trouble of passing the main hook through the base end portion of the jib as in the jib stretching operation by the under-folding type.

Obviously, numerous modifications and variations of the present invention are possible in light of the above teachings. It is therefore to be understood that within the scope of the appended claims, the invention may be practiced otherwise as specifically described herein.

What is claimed as new and desired to be secured by Letters Patent of the United States is:

1. A method for extending an extension jib (2) from a folded position wherein said jib (2) is disposed in an upright posture along one side of a telescopic boom (1), said jib (2) being supported at a fore end of said boom (1) in an extended state via right and left jib foot portions (6, 7) rotatably engaged with horizontal boom point pins (4, 5) extending transversely of said boom (1) at a fore end portion thereof, said right and left jib foot portions (6, 7) being positioned on opposite sides of said extension jib so as to be engageable and disengageable with said boom point pins (4, 5), one (7) of said right and left jib foot portions (6, 7) being rotatable relative to said boom (1) about an axis (y) extending in an axial direction of said jib (2), a jib guide (17) mounted on said boom and including an inclined groove (17*c*) on a jib folding side of a fixed boom section (1A) of said telescopic boom (1), and a guided member (18) provided on said jib (2) for engagement with said jib guide (17); wherein said method comprises:

moving said boom (1) into an inclined position and extending said fore end of said boom such that said guide pin is guided by said jib guide and becomes disengaged from said jib guide;

rotating said jib about a longitudinal axis (x) of said boom point pin (6) into a vertically suspended position; and rotating said jib (2) in said vertical suspended position through a predetermined angle about said axis (y) extending in the longitudinal direction of said jib (2) so as to engage a foot portion of said jib with one of said boom point pins (5); and rotating said jib so as to extend from said fore end portion of said boom.

2. The method for extending a jib as set forth in claim 1, wherein said jib guide (17) further comprises a horizontal groove (17*b*) extending in said longitudinal direction (y) of said boom and an inclined groove (17*c*), and wherein said method further comprises moving said guide member (18) along said horizontal groove and subsequently along said inclined groove (17*c*), and swinging said jib (2) into a vertically suspended position from said folded position as said boom (1) is extended and moved into said inclined position from said horizontal position.

* * * * *